US010161172B2

(12) United States Patent
Wörner

(10) Patent No.: US 10,161,172 B2
(45) Date of Patent: Dec. 25, 2018

(54) DOOR CLOSER FOR A LEAF OF A DOOR OR A WINDOW

(71) Applicant: GEZE GmbH, Leonberg (DE)

(72) Inventor: Benjamin Wörner, Leonberg (DE)

(73) Assignee: GEZE GMBH, Leonberg (DE)

( * ) Notice: Subject to any disclaimer, the term of this patent is extended or adjusted under 35 U.S.C. 154(b) by 306 days.

(21) Appl. No.: 14/895,814

(22) PCT Filed: Jun. 6, 2014

(86) PCT No.: PCT/EP2014/061833
§ 371 (c)(1),
(2) Date: Dec. 3, 2015

(87) PCT Pub. No.: WO2014/195463
PCT Pub. Date: Dec. 11, 2014

(65) Prior Publication Data

US 2016/0123062 A1 May 5, 2016

(30) Foreign Application Priority Data

Jun. 6, 2013 (DE) ..... 10 2013 210 515
Jun. 6, 2013 (DE) ..... 10 2013 210 516

(51) Int. Cl.
*E05F 3/10* (2006.01)
*E05F 1/10* (2006.01)
*E05F 3/18* (2006.01)

(52) U.S. Cl.
CPC ..... *E05F 3/10* (2013.01); *E05F 1/105* (2013.01); *E05F 1/1083* (2013.01); *E05F 3/102* (2013.01);
(Continued)

(58) Field of Classification Search
CPC ... E05F 3/10; E05F 3/102; E05F 3/104; E05F 3/18; E05F 1/105; E05F 1/1083
See application file for complete search history.

(56) References Cited

U.S. PATENT DOCUMENTS 3,059,268 A 10/1962 McHale
4,658,487 A * 4/1987 Gachot ..... B23P 13/04 29/417

(Continued)

FOREIGN PATENT DOCUMENTS

DE 19524779 A1 1/1997
DE 19626831 C1 * 1/1998 ..... E05F 3/10

(Continued)

*Primary Examiner* — Victor D Batson
*Assistant Examiner* — Matthew J Sullivan
(74) *Attorney, Agent, or Firm* — Harness, Dickey & Pierce, P.L.C.

(57) ABSTRACT

The invention relates to a retracting device for a leaf of a door or a window, comprising a housing, a piston which is arranged in a receiving area of the housing and which is urged by a spring, and a shaft which is mounted in the housing and which interacts with the piston, an actuating arm for the leaf being arranged on the shaft in a non-rotatable manner. At least one first driving element is arranged on the shaft, the head surface of said driving element forming a freewheel device with a freewheel region, wherein an arrangement of the piston or a tooth of a toothing of the piston slides on the freewheeling region so as to decouple the shaft from the piston.

15 Claims, 12 Drawing Sheets

Figure 1:
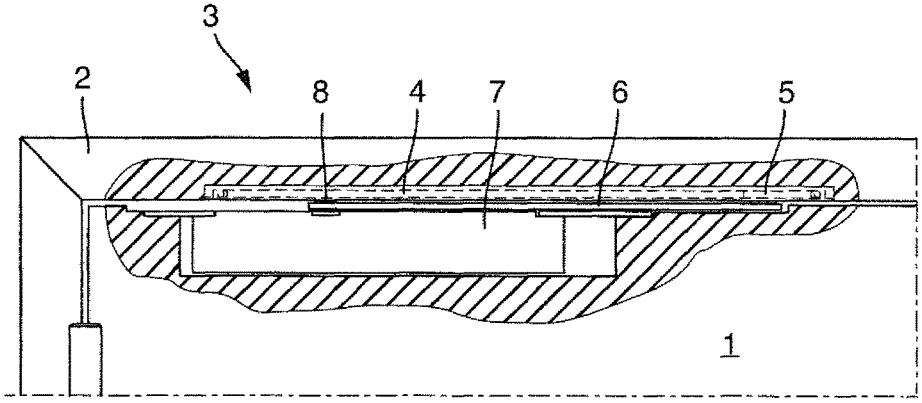

(52) U.S. Cl.
CPC ..... *E05F 3/104* (2013.01); *E05F 3/18* (2013.01); *E05Y 2201/214* (2013.01)

(56) References Cited

U.S. PATENT DOCUMENTS

| | | | | | |
|---|---|---|---|---|---|
| 4,663,800 | A | | 5/1987 | Mettenleiter et al. | |
| 4,847,946 | A | | 7/1989 | Nam et al. | |
| 5,265,306 | A | * | 11/1993 | Yu | E05F 3/10 16/51 |
| 2012/0279013 | A1 | | 11/2012 | Wildforster | |

FOREIGN PATENT DOCUMENTS

| | | | | | |
|---|---|---|---|---|---|
| DE | 102009000539 | A1 | | 8/2010 | |
| EP | 2388422 | B1 | * | 7/2015 | E05F 3/10 |
| FR | 1375021 | A | * | 10/1964 | E05F 3/102 |
| GB | 684207 | A | * | 12/1952 | E05F 3/10 |

* cited by examiner

DOOR CLOSER FOR A LEAF OF A DOOR OR A WINDOW

CROSS REFERENCE TO RELATED APPLICATIONS

This application is a U.S. National Phase Application under 35 U.S.C. 371 of International Application No. PCT/EP2014/061833 filed on Jun. 6, 2014 and published in German as WO 2014/195463 A1 on Dec. 11, 2014. This application is based on and claims the benefit of priority from German Patent Application No. 102013210515.0 and 102013210516.9, both filed on Jun. 6, 2013. The entire disclosures of all of the above applications are incorporated herein by reference.

The invention relates to a retraction apparatus for a leaf of a door of or a window in accordance with the preamble of claim 1.

A door closer having a switchable free-running function is known from DE 195 24 779 A1. A piston is arranged displaceable against a spring in a housing filled with a hydraulic fluid. The piston can be connected to a leaf of a door via a toothed arrangement and a pinion via a lever arrangement. The spring which is supported on the piston is supported at the other end on a separating piston which is likewise arranged displaceable in the housing and which is hydraulically switchable. The spring can thereby be held in the clamped state between the piston and the separating piston, whereby a free running can be effected for the leaf of the door.

The arrangement is complex and a hydraulic switching apparatus is required. An independent retraction of the freely movable leaf close to the closing position of the leaf into the closing position is not provided.

A fixing apparatus for a door closer is known from DE 34 33 891 A1, wherein a cam gear of the door closer can be blocked in that blocking members formed as balls are placed at a cross-sectional extension of a displaceable hollow cylinder through the slanted surface of a conical part and are supported toward the outside against the inner surface of the hollow cylinder.

Only a fixing of the door closer in an open position of the leaf of the door takes place, wherein the fixing is switched by an electromagnet in a complex and expensive manner.

DE 10 2009 000 539 A1 discloses a door closer having a housing and a piston guided in the housing and having a piston rod. A spring is furthermore arranged in the housing which is acted on during the opening of the leaf and which is configured for an independent closing of the leaf. A fixing device is provided for the fixing of the piston in the working cylinder having an axial blocking possibility of the piston via blocking means of the fixing device. A holding spigot arranged at the piston rod is supported against the force of the spring at the housing via a latching rocker when the fixing device is activated to fix the piston in the closing direction.

A complex and expensive fixing of the spring of the door closer takes place here by switching an electromagnet. A retraction of the leaf into the closing position is not possible with a fixed spring.

It is the underlying object of the invention to provide a retraction apparatus for a leaf of a door or of a window, wherein the leaf is substantially freely movable, but is also securely guided into its closing position.

The object is satisfied by the features of claim 1.

The dependent claims form advantageous embodiment possibilities of the invention.

The retraction apparatus is provided for a pivotable door or for a window whose leaf is supported in hinges at a frame. The retraction apparatus can be designed such that the leaf is freely movable over a wide region as if no apparatus were arranged at the door. In the region close to the closed position of the leaf, the leaf is actively retracted into this closed position In this respect, the retraction movement is additionally damped to avoid a violent slamming of the leaf. A position for the open position is furthermore provided for the leaf, wherein the leaf close to this open position location is pulled open into said open position location by the retraction apparatus.

The retraction apparatus has an energy store formed as a spring which retracts the leaf close to the closed position. To allow a free movement of the leaf, at least one free-running device is provided which allows the leaf to be decoupled from the energy store. In a manner similar to a manual door closer, the leaf of the door is operationally connected via a linkage to a shaft which has at least one entrainer which cooperates with stops or with a toothed arrangement of a piston displaceably arranged in the retraction apparatus. The operational connection between the shaft and the piston is releasable and forms the free-running device, whereby the shaft can be decoupled from or coupled to the piston acted on by the spring. The coupling is advantageously only present at small opening angles of the leaf of the door so that the leaf is freely movable at larger opening angles. On a return of the leaf close to the closing position, the coupling between the piston acted on by the spring and the shaft is established again. The spring, which is loaded on the initial opening movement, releases the energy stored in it again and the leaf is guided into its closing position.

A coupling of the piston to the shaft in an open position of the leaf furthermore takes place again in the opening direction subsequent to the region in which the leaf is freely movable so that a pulling open of the leaf into this open position takes place in which the leaf is fixed. An abutting of the leaf at a wall or the like is thus advantageously also avoided when the leaf is, for example, thrown open forcefully.

Embodiments in the drawing will be described in more detail in the following with reference to the Figures.

Figure 2:
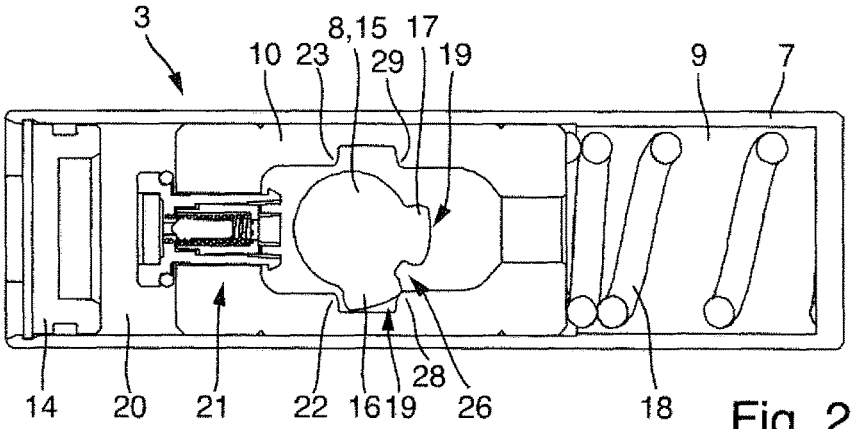
Figure 3:
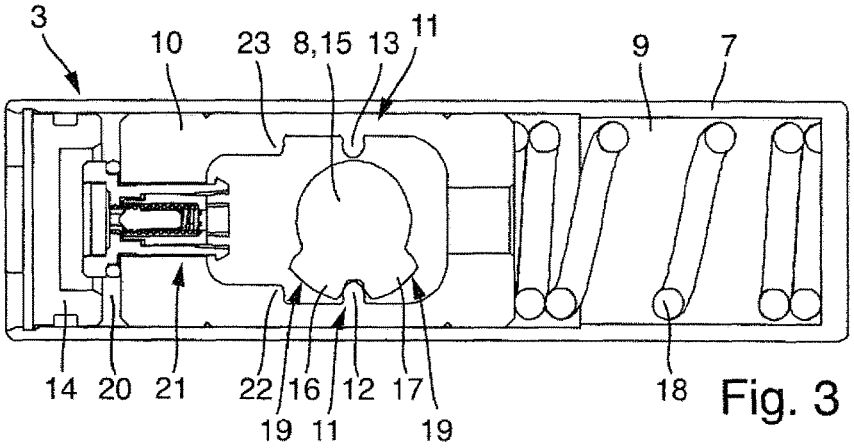
Figure 4:
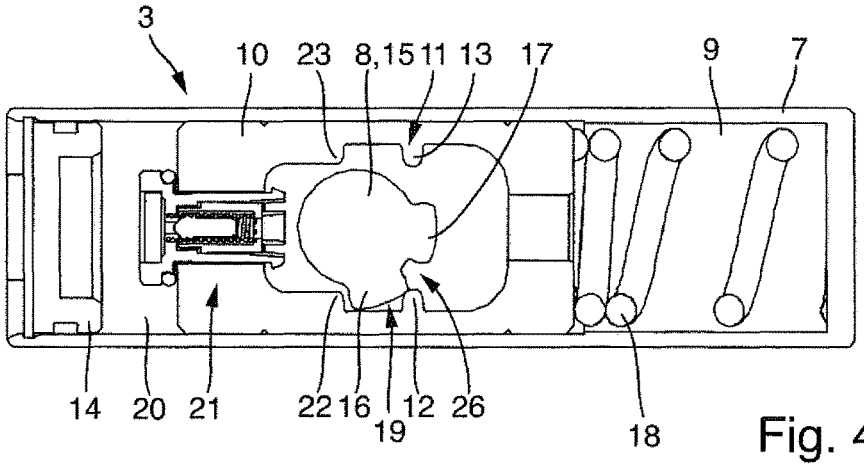
Figure 5:
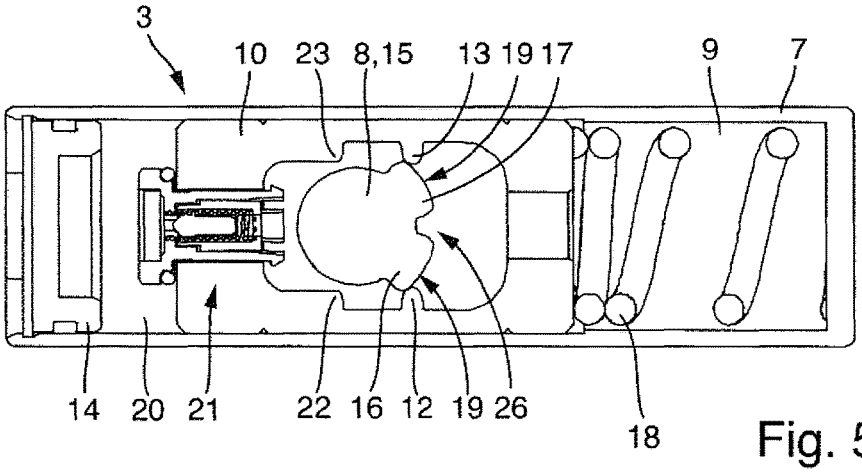
Figure 6:
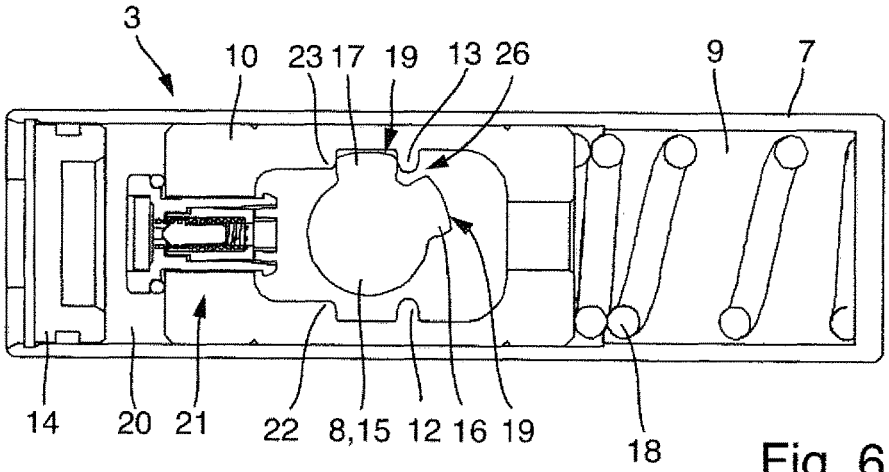
Figure 7:
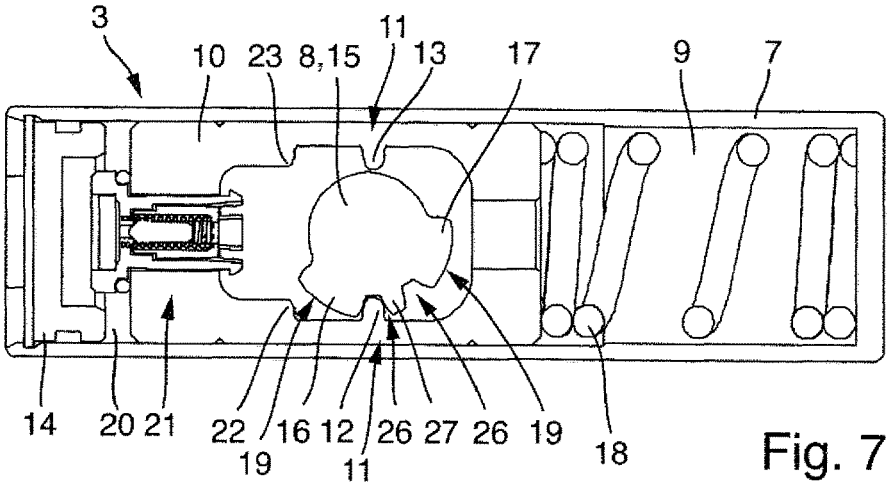
Figure 8:
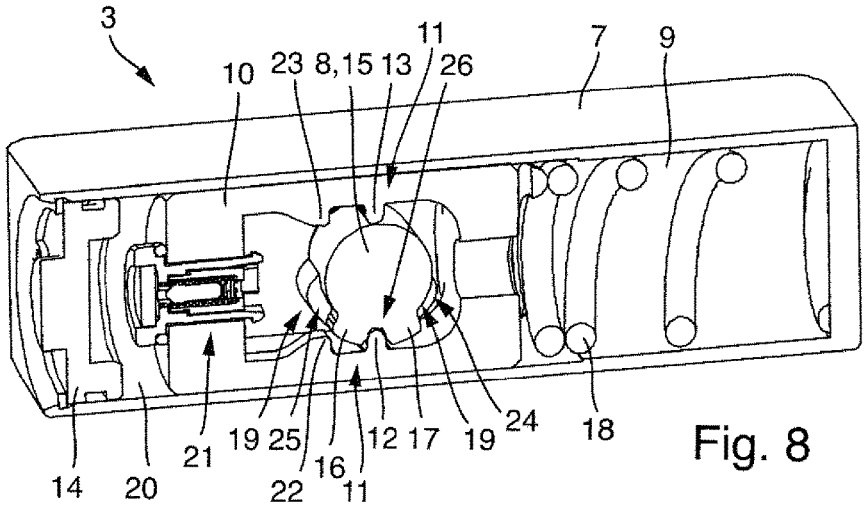
Figure 9:
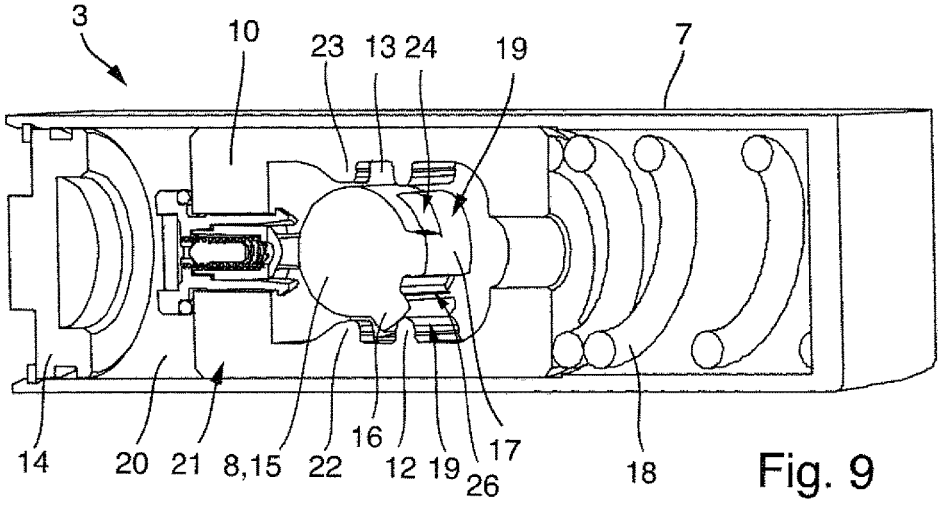
Figure 10A:
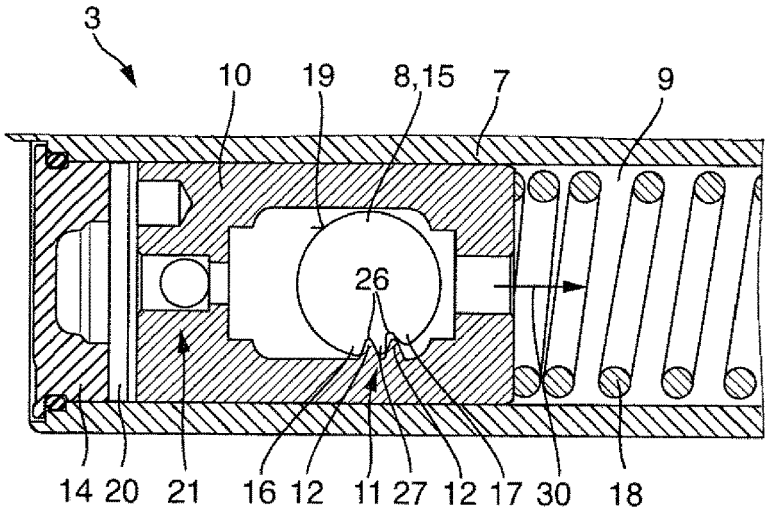
Figure 10B:
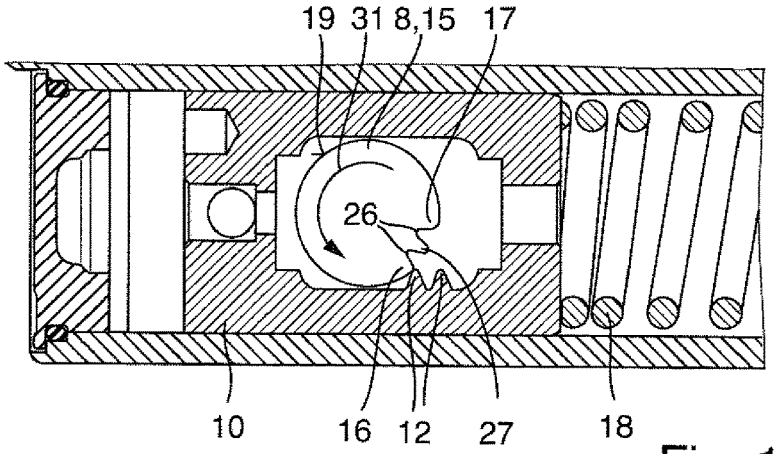
Figure 10C:
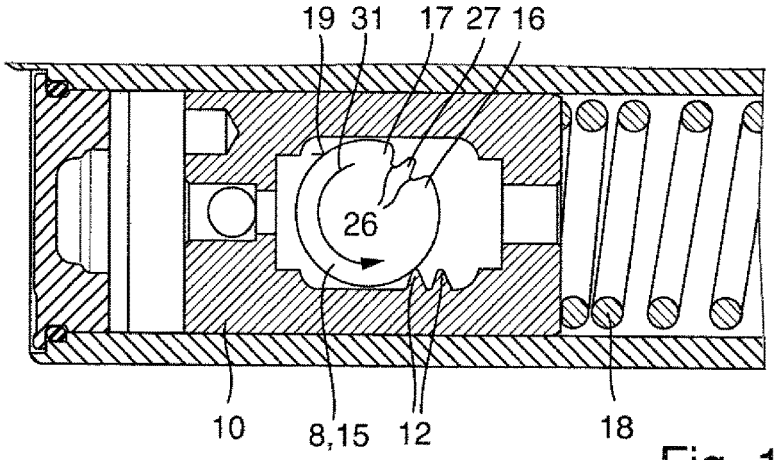
Figure 11:
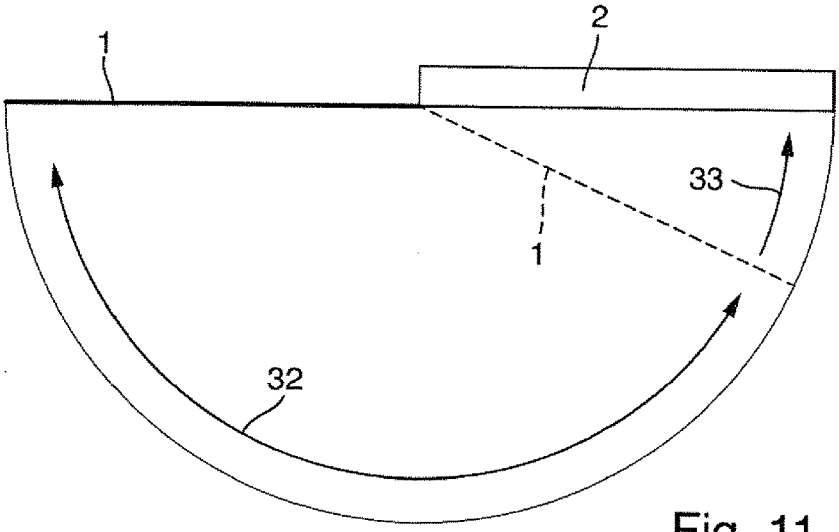
Figure 13:
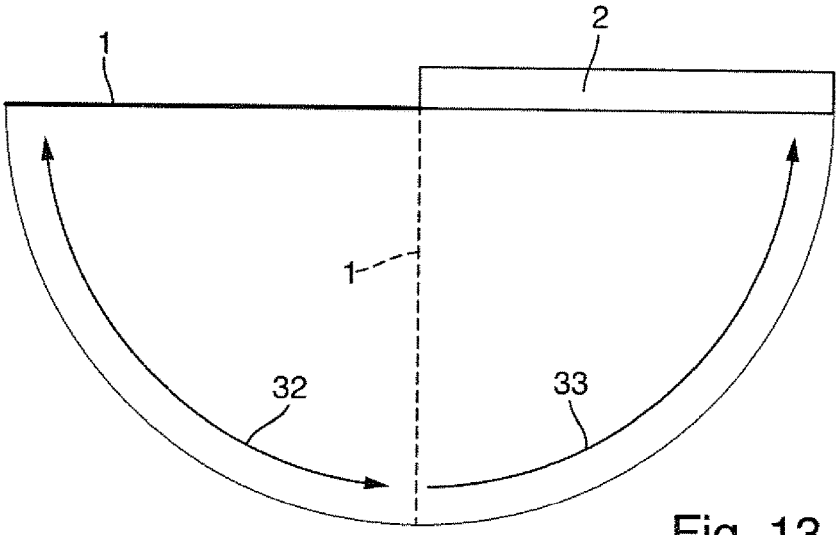
Figure 14A:
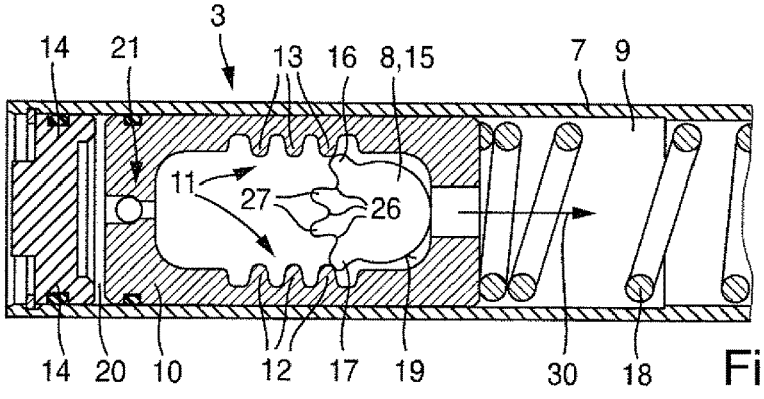
Figure 14B:
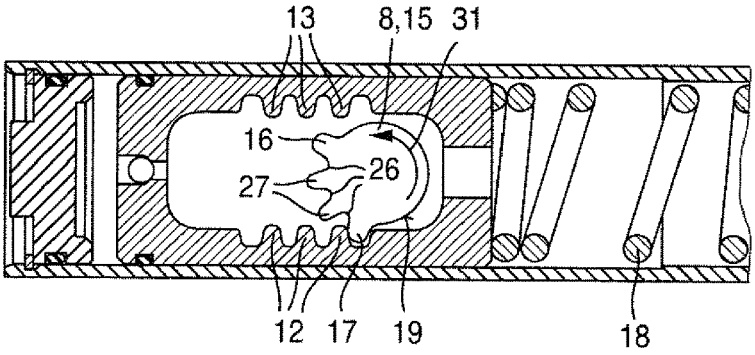
Figure 14C:
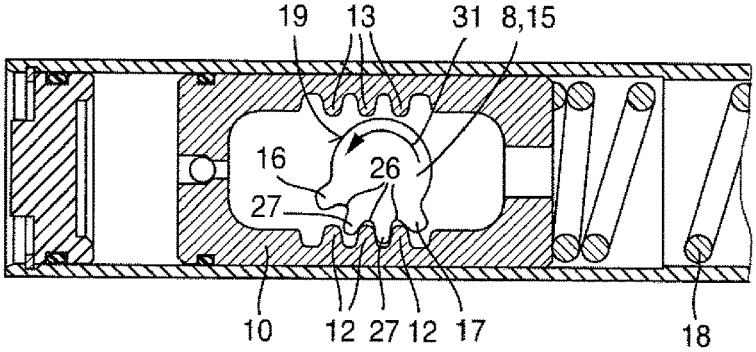
Figure 14D:
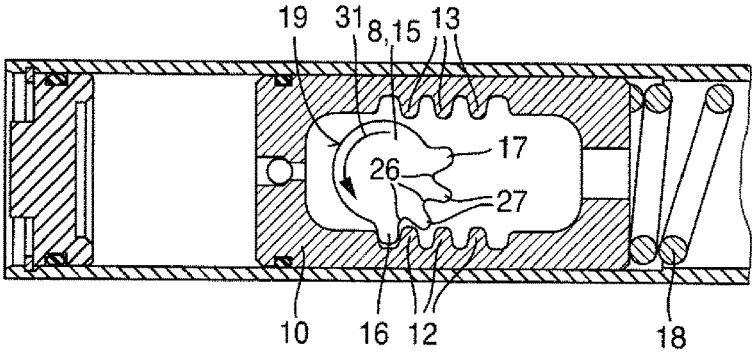
Figure 14E:
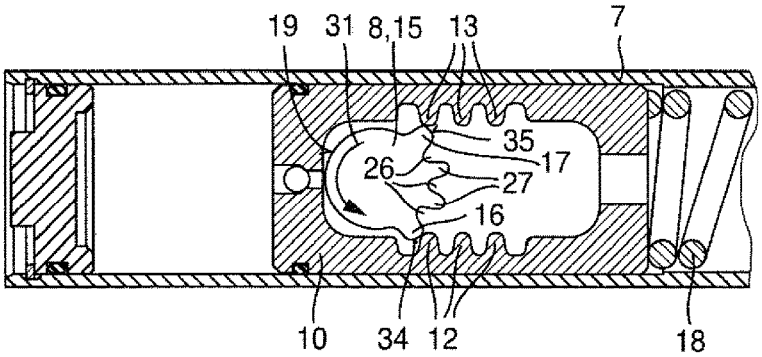
Figure 14F:
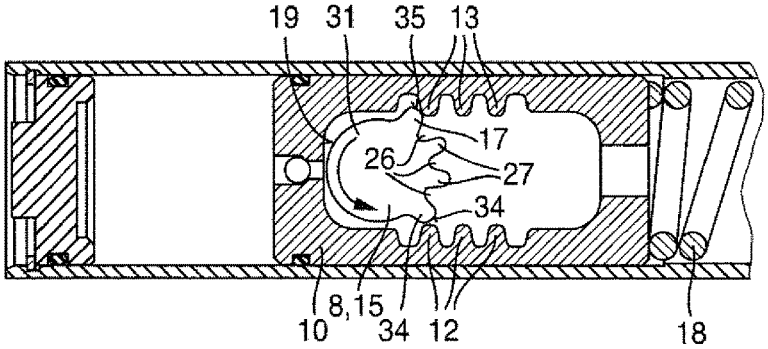
Figure 14G:
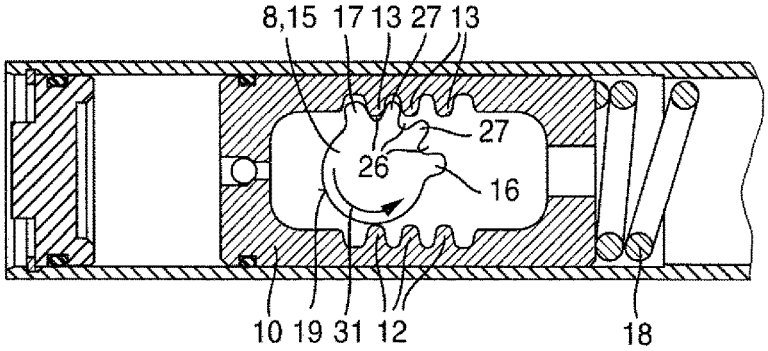
Figure 14H:
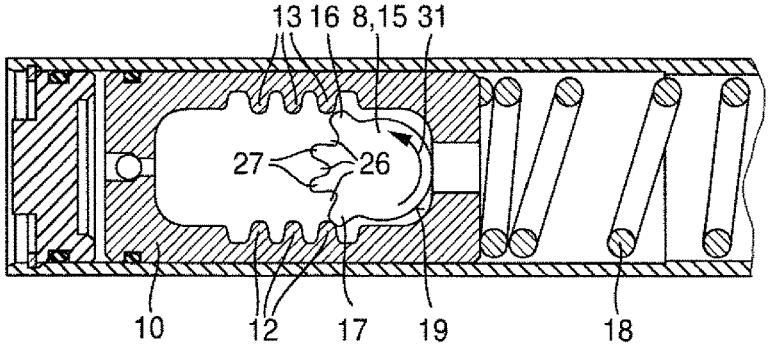
Figure 15:
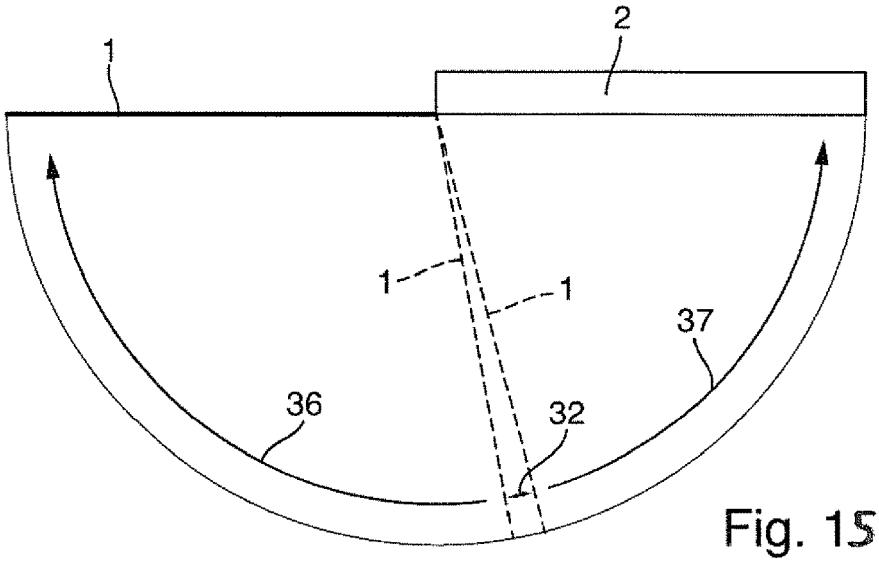
Figure 18:
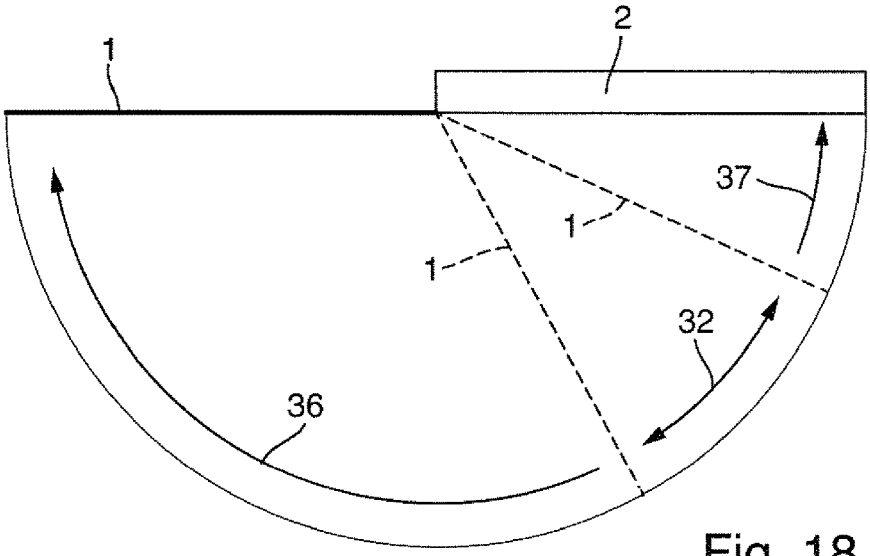
Figure 16A:
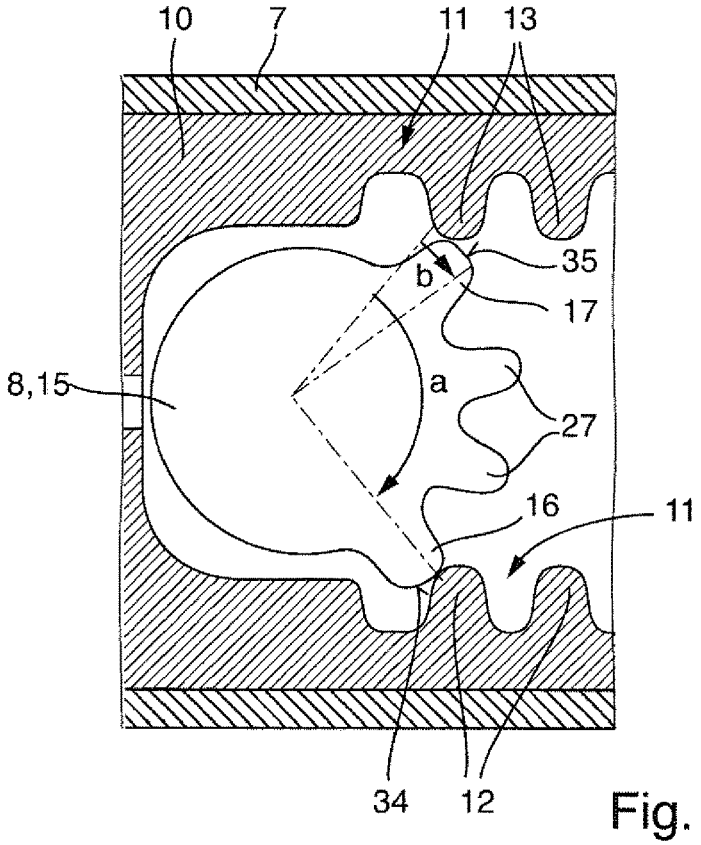
Figure 16B:
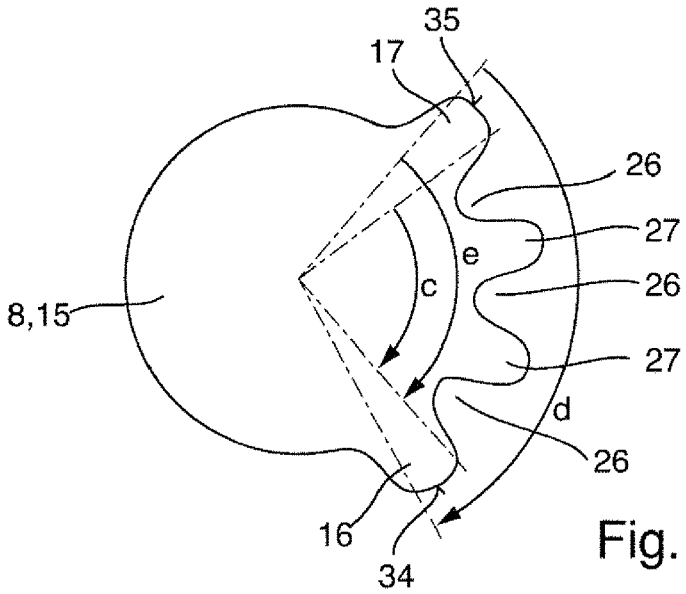
Figure 17A:
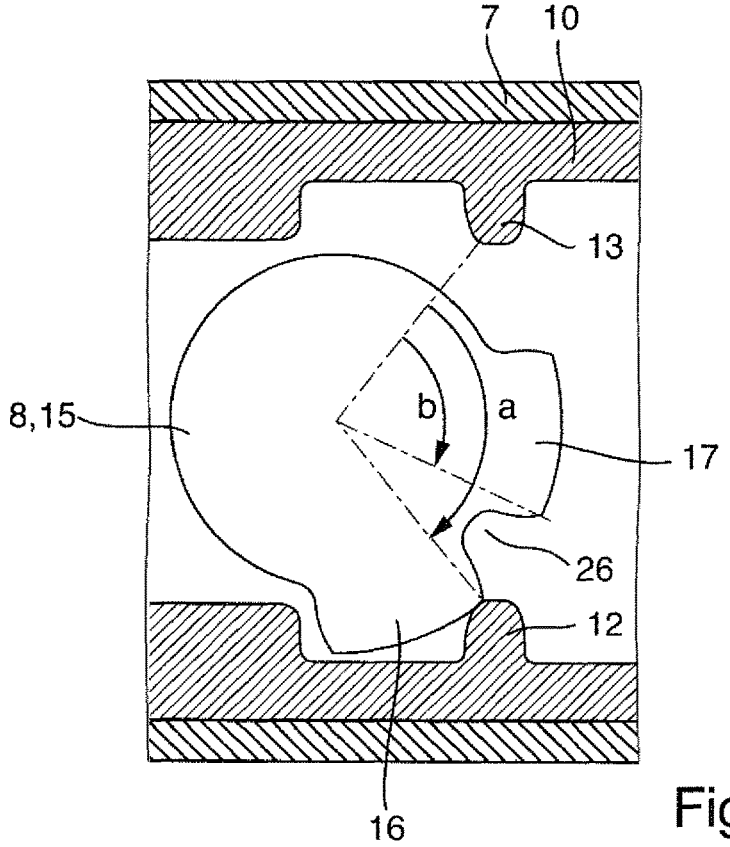
Figure 17B:
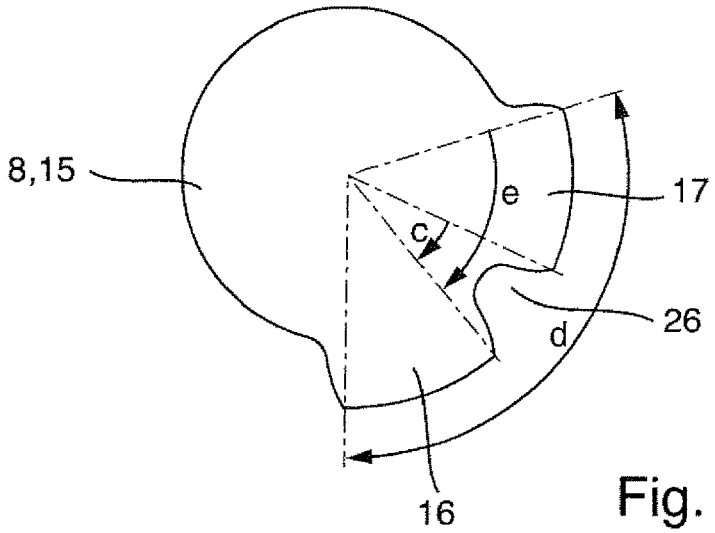

There are shown:

FIG. 1 a detail of a leaf of a door with an associated frame and with a part-section of the installed situation of an integrated retraction apparatus;

FIG. 2 a first embodiment of the retraction apparatus with a free-running device in section;

FIG. 3 a second embodiment of the retraction apparatus with a free-running device in section in the starting position with a closed leaf;

FIG. 4 the retraction apparatus in accordance with FIG. 3 in a position with a slightly opened leaf at the start of the free run;

FIG. 5 the retraction apparatus in accordance with FIG. 4, but with a further opened leaf in the region of the handover of the free run;

FIG. 6 the retraction apparatus in accordance with FIG. 4 in a position with an even further opened leaf at the start of the retraction into an open position;

FIG. 7 a third embodiment of a retraction apparatus, with a pinion tooth;

FIG. 8 a further embodiment of the retraction apparatus with an extended free-running region in the starting position;

FIG. 9 a further view of the retraction apparatus in accordance with FIG. 8 at the start of the handover of the free-running region;

FIGS. 10*a-c* a further embodiment of the retraction apparatus in three open states of a door;

FIG. 11 a representation of the door movement of the embodiment of FIG. 10;

FIGS. 12*a-d* a further embodiment of the retraction apparatus in four different door open positions;

FIG. 13 a representation of the door movement of the embodiment of FIG. 12;

FIGS. 14*a-h* still a further embodiment of the retraction apparatus in different open positions of a door;

FIG. 15 a representation of the door movement of the embodiment of FIG. 14;

FIGS. 16*a-b* a detail enlargement of the embodiment of FIG. 14 with drawn angles to determine the pinion design;

FIGS. 17*a-b* a representation in accordance with FIG. 16 for an embodiment with two entrainers and two oppositely disposed teeth at the piston; and FIG. 18 a representation of the door movement in an embodiment of the retraction apparatus with oppositely disposed stops or toothed arrangements at pistons.

In FIG. 1, a retraction apparatus 3, integrated in a leaf 1 of a door, for the leaf 1 pivotably supported in hinges 1 is shown together with an associated frame 2.

A slide rail 4 in which a slider 5 is guided is installed in the frame 2. The slider 5 is rotatably arranged at an end of an actuation arm 6, wherein the other end of the actuation arm 6 is rotationally fixedly connected to a shaft 8 of the retraction apparatus 3. The retraction apparatus 3 can also be integrated in the frame 2 and the slide rail 4 can be integrated in the leaf 1. An arrangement of the retraction apparatus 3 or of the slide rail 4 lying on the leaf 1 or on the frame 2 is also possible.

The retraction apparatus 3 is shown in FIG. 2 which has a housing 7 which is filled with a hydraulic fluid and in which the shaft 8 is rotatably supported which engages through a piston 10 which is cut out in its interior and which is displaceably guided in a reception space 9 in the housing 7. The piston 10 has abutments 22, 23 and stops 28, 29 respectively opposite one another inwardly along its extent. At the end side, the reception space 9 of the housing 7 can be sealingly closed at one side or at both sides by a closing cover 14.

A pinion 15 of the shaft 8 cooperates with the abutments 22, 23 and with the stops 28, 29 of the piston 10 for its displacement, with the term pinion 15 here not to be understood as a toothed wheel in the conventional sense surrounding the shaft 8. The pinion 15 is rather reduced to two adjacently arranged entrainers 16, 17 which correspond to teeth with particularly wide tip surfaces. A tooth space 26 is formed between the entrainers 16, 17 as in a conventional pinion.

A spring 18 as an energy store acts on the piston 10, wherein the spring 18 can be set out of effect with respect to the shaft 8 and thus to the leaf 1 by a free-running device which is formed by a free-running region 19. The free-running region 19 is formed by the head surfaces of the entrainers 16, 17. The spring 18 can, as shown here, be supported at the end side at the housing 7 or alternatively at a spring side closing cover 14. At the side of the piston 10 disposed opposite the spring 18, a damping space 20 is formed in the reception space 9 by the piston 10 guided in a sealed manner in the reception space 9, wherein a valve arrangement 21 is arranged in the piston 10 at the front side toward the damping space 20, said valve arrangement permitting a movement of the piston 10 in the opening direction without impediment. In the closing direction, the valve device 21 effects a damping of the movement of the piston 10. Alternatively or additionally, one or more overflow passages can be arranged in the housing 7 and valves for influencing the behavior of the retraction apparatus which are accessible from the outside and which can be set can be arranged in them.

It is shown in FIG. 2 that the first entrainer 16 rotates counter-clockwise with the shaft 8 on an opening movement of the leaf 1, whereby the first entrainer 16 displaces the piston 10 in the direction of the spring 18 by contact with the stop 28. On the further opening movement of the leaf 1, the first entrainer 16 slides on the stop 28, whereby the first entrainer 16 slides into the free-running region 19, whereby the shaft 8 is decoupled from the piston 10 and thus from the spring 18 since no further displacement of the piston 10 takes place in the direction of the spring 18, The leaf 1 is thus freely movable as if no retraction apparatus 3 were present. The second entrainer 17 is effective in conjunction with the stop 29 in another installation arrangement of the retraction apparatus 3.

The function and mode of operation will be described in detail with reference to the second embodiment which is shown in FIGS. 3 to 6 and which relates to an improved embodiment of the retraction apparatus 3. In accordance with the second embodiment, the piston 10 has toothed arrangements 11, which are respectively opposite one another inwardly, along its extent, with each toothed arrangement 11 having at least one tooth 12, 13. The pinion 15 of the shaft 8 in this respect cooperates with the toothed arrangements 11 of the piston 10 for its displacement in that one of the teeth 12, 13 engages into the tooth spacing 26 formed between the entrainers 16, 17. In the starting position of the retraction apparatus 3 shown in FIG. 3 with a closed leaf 1, the lower tooth 12 is in engagement with the tooth spacing 26 between the entrainers 16, 17. Starting from this starting position of the retraction apparatus 3 with a closed leaf 1, the shaft 8 is rotated counter-clockwise on the opening of the leaf 1, whereby the first entrainer 16 cooperates with the first tooth 12 and displaces the piston 10 in the direction of the spring 18. In FIG. 4, the piston 10 is displaced so far that the first tooth 12 slides onto the first entrainer 16 into the free-running region 19 and slides along it, whereby the shaft 8 is decoupled from the piston 10 and thus from the spring 18 since no further displacement of the piston 10 in the direction toward the spring 18 takes place. The leaf 1 is thus freely movable as if no retraction apparatus 3 were arranged.

In the position of the shaft 8 shown in FIG. 5 with a further opened leaf 1, the second tooth 13 moves into the free-running region 19 of the second entrainer 17, with the first tooth 12 still being located in the free-running region 19 of the first entrainer 16. A handover of the free-run in which the leaf 1 is freely movable thereby takes place from the first entrainer to the second entrainer.

If the leaf 1 is opened even further, a transition of the second tooth 13 in engagement into the tooth spacing 26 between the entrainers 16, 17 takes place, whereby the shaft 8 is again coupled to the piston 10, as is shown in FIG. 6. The second tooth 13 rotates the second entrainer 17 and thus the shaft 8 counter-clockwise by the piston 10 acted on by the force of the loaded spring 18 in the direction toward the pressure space 20, with the spring 18 relaxing. The leaf 1 is thereby pulled open, whereby a pulling open of the leaf 1 freely movable up to then into an open position is effected in which the leaf 1 is held. The pulling open of the leaf 1 into the open position takes place by the valve arrangement 21 or damped by optionally additionally arranged valves.

The abutments 22, 23 are furthermore formed at the piston 10 with which abutments the respective associated entrainers 16, 17 cooperate. If the freely movable leaf 1 is forcefully thrown open in the direction of the open position, the entrainer 16, 17 already comes into contact with the abutment 22, 23 before the tooth 12, 13 is completely received in the tooth spacing 26 between the entrainers 16, 17. It is shown in FIG. 6 that the entrainer 17 contacts the abutment 23, with the tooth 13 just sliding out of the free-running region 19 into the tooth spacing 26. The displacement movement of the piston 10 which takes place by the contact of the entrainer 16, 17 at the abutment 22, 23 is damped by the valve arrangement 21, whereby the movement of the leaf 1 is damped.

The procedure takes place in reverse order in the closing direction of the leaf 1. Starting from the pulled-open open position of the leaf 1 in accordance with FIG. 6, in which the leaf 1 is held, the leaf 1 is moved in the closing direction. The shaft 8 is in this respect rotated clockwise, whereby the second tooth 13 displaces the piston 10 toward the spring 18 due to said tooth's contact at the second entrainer 17, whereby the spring 18 is again relaxed. The second tooth 13 subsequently slides onto the second entrainer 17 into the free-running region 19, whereby the leaf 1 is again decoupled from the spring 18. On a further movement of the leaf 1 in the closing direction, the handover of the free-run shown in FIG. 5 again takes place, now from the second entrainer 17 to the first entrainer 16, in that the first tooth 12 moves into the free-running region 19 of the first entrainer 16 before the second tooth 13 leaves the free-running region of the second entrainer 17.

On the return of the leaf 1 close to the closing position, the coupling between the shaft 8 and the piston 10 is established again in that the first tooth 12 leaves the free-running region 19 on the first entrainer 16 by the rotation of the shaft 8 clockwise and engages into the tooth spacing 26, whereby the first tooth 12 is in engagement with the first entrainer 16. The first tooth 12 now rotates the first entrainer 16 and thus the shaft 8 clockwise by the piston 10 acted on by the force of the loaded spring 18 in the direction toward the damping space 20, with the spring 18 relaxing and the position shown in FIG. 3 again being reached. The leaf 1 is actively retracted into its closing position, wherein the retraction takes place damped due to the valve arrangement 21 or due to valves alternatively or additionally provided in overflow passages in the housing 7.

The retraction apparatus 3 can be unchangedly arranged both at left-hinged doors and at right-hinged doors or also alternatively at or in the frame 2 due to the symmetrical design of the piston 10 of the retraction apparatus 3 with respect to the toothed arrangement 11. In the closing position of the leaf 1, with a reverse arrangement, the second tooth 13 then lies in the tooth spacing 26 between the entrainers 16, 17 and the first tooth 12 stands in the open position of the leaf in engagement between the entrainers 16, 17.

A piston 10 having only a one-side toothed arrangement 11 is furthermore also conceivable which only effects a damped retraction of the leaf 1. The entrainers 16, 17 can then coincidingly be formed as circularly peripheral, with the circle shape only being interrupted by the tooth spacing 26.

A third embodiment is shown in FIG. 7, wherein a pinion tooth 27 is arranged between the two entrainers 16, 17. Two tooth spacings 26 are thereby produced, wherein the tooth spacing 26 between the first entrainer 16 and the pinion tooth 17 cooperates with the first tooth 12. The second tooth 13 correspondingly cooperates with the tooth spacing 26 which is arranged between the pinion tooth 27 and the second entrainer 17. A larger region is thereby advantageously possible with respect to the opening angle of the leaf 1.

A further embodiment of the retraction apparatus 3 is shown sectioned in an oblique projection in FIGS. 8 and 9, with a free design of the free-running region 19 advantageously being possible. The pinion 15 is designed in this respect such that the free-running region 19 is respectively extended with respect to the periphery of the pinion 15 so that a respective shoulder 24, 25 arises in which the associated abutment 22, 23 can engage. The abutments 22, 23 are configured here in the manner of narrow teeth with respect to the first embodiment so that they can engage into the lowered region of the shoulders 24, 25 at the pinion 15 and cooperate in accordance with the first embodiment with the entrainers 16, 17. An improved handover of the free-run of the leaf 1 from the first tooth 12 to the second tooth 13 is advantageously achieved by the extended free-running region 19, as is shown in FIG. 9. In this respect, the transitions have a gentler design since the free-running region 19 is formed as a free-running contour and is respectively formed as variably radially increasing with respect to the tooth 12, 13 taking over.

The embodiment shown in FIG. 10 has a similar design to the embodiment of FIG. 7, with the piston 10, however, only being provided with two teeth 12 at one side.

The pinion 15 accordingly has two tooth spacings 26 which are formed between a pinion tooth 27 and two entrainers 16, 17. The entrainers 16, 17 are led together in the peripheral direction here so that the pinion 15 has an uninterrupted circular cross-section with the exception of the region of the tooth spacings 26.

A piston 10 having only a one-side toothed arrangement 11 is also conceivable which only effects a damped retraction of the leaf 1. The entrainers 16, 17 can then coincidingly be formed as circularly peripheral, with the circle shape only being interrupted by the tooth spacing 26.

FIG. 10*a* shows the retraction apparatus with a closed door. The spring is preloaded and is loaded further on the opening of the door in accordance with arrow 30. The position of the retraction apparatus is shown in FIG. 10*b* at a door opening angle of approximately 30°. The shaft 8 with the pinion 15 is rotated so far counter-clockwise in accordance with arrow 31 until the radial sliding surface of the pinion 8 forming the free-running region 19 lies on the contact surface of the piston 10 formed by the tooth 12 at the left in FIG. 10*b*. The shaft 8 is decoupled from the piston 10 from this rotational position onward so that the door can be further opened freely without loading by the spring 18. This free movement of the door is shown in FIG. 10*c*. It can be seen that the piston 10 is not moved along on the rotation of the shaft 8 in accordance with arrow 31. The spring 18 is accordingly not further compressed. On the closing of the door, the shaft 8 is rotated back against arrow 31 and is finally again coupled to the piston 10 via the tooth spacings 26 and the teeth 12, whereby the door is pulled closed by relaxing the spring 18.

FIG. 11 shows the door movement in accordance with the embodiment of FIG. 10 in a schematic representation. The double arrow 32 designates the free-running region of the leaf 1 and the arrow 33 designates the coupled region with a door opening angle of >approximately 30° at which the door is pulled closed under the action of the spring 18. As in the previously described examples, a damping also preferably takes place by a corresponding valve arrangement and/or via overflow passages. The dashed representation of the door leaf 1 corresponds to the moment of the coupling or decoupling of the pinion 15 with the piston 10.

The embodiment shown in FIG. 12 substantially corresponds to the embodiment of FIG. 10. Instead of two teeth, the piston 10, however, has four teeth 12 at one side. The pinion 15 is accordingly provided with four tooth spacings 26 which are formed between corresponding pinion teeth 27 and two entrainers 16, 17. The entrainers 16, 17 are here also led together in the peripheral direction of the pinion so that a region of the pinion 15 results which has a through-going shape of a circular section in cross-section.

Figure 12A:
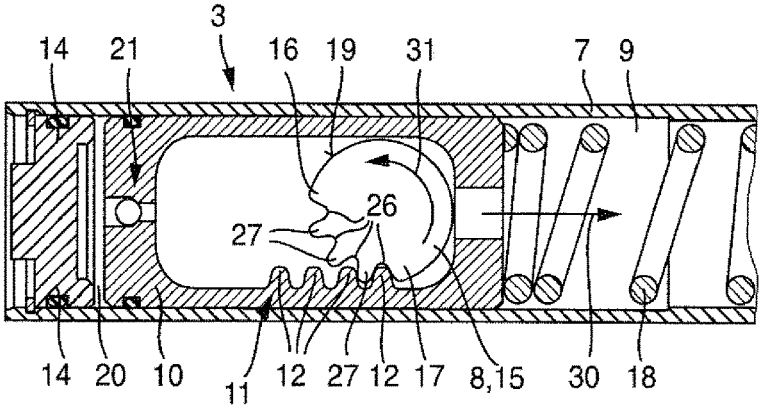
Figure 12B:
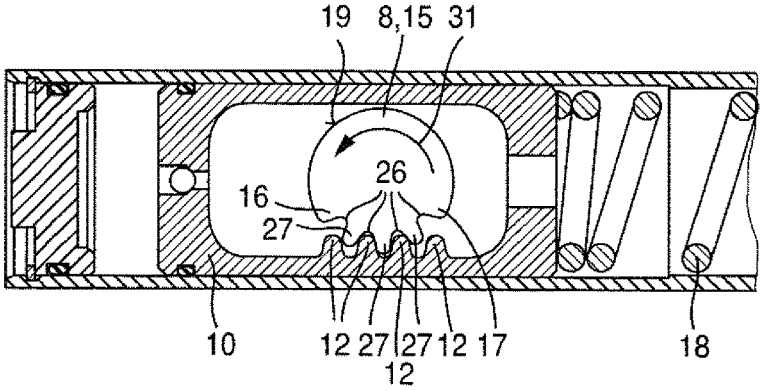

FIG. 12*a* again shows the state with a closed door and with a preloaded spring 18. FIG. 12*b* shows a state with a slightly opened door. The pinion 15 was rotated counter-clockwise in accordance with arrow 31, whereby the piston 10 in FIG. 12*b* was moved to the right and the spring 18 is further loaded. The pinion 15 and the piston 10 are, however, still coupled.

Figure 12C:
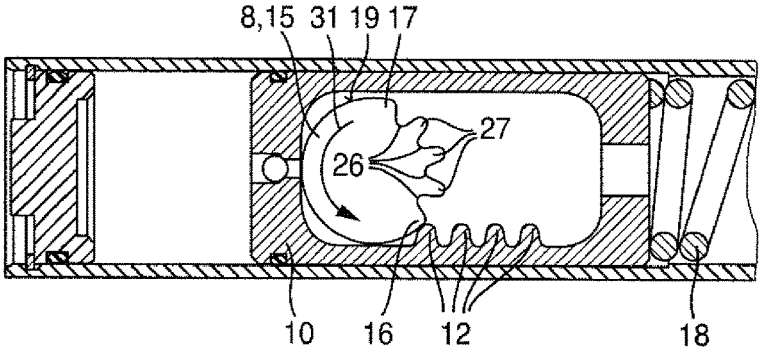
Figure 12D:
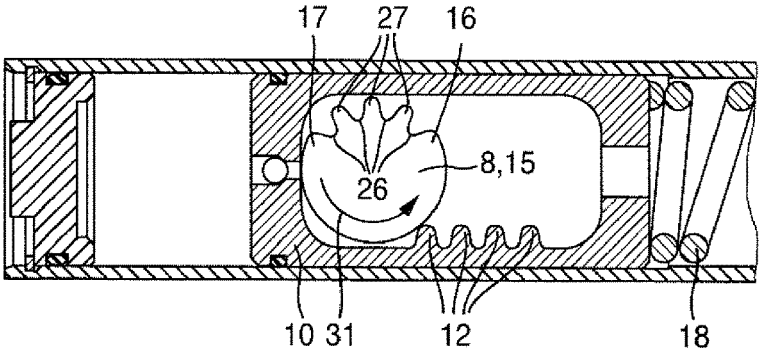

The state is in turn shown in FIG. 12*c* in which a decoupling of the pinion 15 from the piston 10 takes place. The door is here opened approximately 90°, the spring 18 is further compressed. The radial sliding surface of the pinion 15 forming the free-running region 19 lies on the contact surface of the piston 10 formed by the tooth 12 fully at the left. On the further opening of the door, the pinion 15 rotates as shown in FIG. 12*d* without displacing the piston 10 and thus without a further compression of the spring 18. The door is free-running. When the door is closed, the shaft 8 is again rotated in the reverse direction until the pinion 15 is again coupled to the piston 10, whereby the door is pulled closed in a damped manner under the pressure of the spring 18.

The door movement of the embodiment of FIG. 12 is again shown schematically in FIG. 13. The free-running region is marked by the double arrow 32 and the coupled closing region by arrow 33. The leaf 1 shown dashed designates the position of the door on coupling or decoupling which is present at a door opening of approximately 90°. The opening angle of the door at which this takes place can be varied via the number of teeth 12 of the piston 10 and of the pinion teeth 27.

An embodiment is shown in FIG. 14 which is similar to that of FIG. 12. The piston 10 is, however, symmetrically provided with three teeth 12 at the bottom and with three teeth 13 at the top here which cooperate with corresponding tooth spacings 26 of the pinion 15. The different door positions are shown in FIGS. 14*a* to 14*h*, with FIG. 14*a* showing the state with a closed door and a preloaded spring 18.

FIGS. 14*b* to 14*d* show the opening of the door with a rotation of the shaft 8 and an increasing loading of the spring 18 until just before the decoupling which is then shown in FIG. 14*e*. This decoupling takes place at a door opening angle of approximately 75°. The entrainer 16 also formed as a tooth has a radial sliding surface 34 which also runs onto the contact surface of the piston 10 formed by the lower left tooth 12. On a further rotation, the piston 10 is therefore not moved further to the right; the spring is not further loaded.

If the pinion 15 is rotated still further in accordance with arrow 31, a handover takes place from the sliding surface 34 of the first entrainer 16 to the sliding surface 35 of the second entrainer 17, as is shown in FIG. 14*f*. The piston 10 is therefore still not moved further to the right; the spring 18 is not further loaded.

Only on the still further rotation of the pinion 15 in accordance with arrow 31 does a coupling then again take place between the pinion 15 and the piston 10 via the upper teeth 13. This takes place at a door opening angle of approximately 85°, as shown in FIG. 14*g*. The preloaded spring 18 can now output its stored energy and press open the door by rotating the shaft 8 in the direction of the arrow 31. At approximately 170°, the pinion 15 can also be decoupled from the piston 10 again, as shown in FIG. 14*h*, whereby the door is again free-running.

The closing of the door then again takes place in the reverse direction, with the spring 18 being loaded again by coupling the pinion 15 into the upper teeth 13 and by displacing the piston 10 to the right. This is followed by a free-running region in accordance with FIGS. 14*e* and 14*f* and by a decoupling in accordance with FIG. 14*d* and finally a pressing closed of the door under the effect of the spring 8, which then relaxes again, in accordance with FIGS. 14*c* to 14*a*, in the reverse direction and preferably with a simultaneous damping. The pulling open of the door also preferably takes place with damping.

FIG. 15 again schematically shows the door opening movement. Due to the symmetrical design of the piston, the leaf is both pulled open in accordance with the arrow 36 and closed in accordance with the arrow 37 under the force of the spring 18. A small free-running region lies therebetween which is marked by arrow 32 and which is located between the two dashed leaf positions in which the pinion 15 and the piston 10 are respectively coupled or decoupled. The opening angle at which the coupling or decoupling takes place can again be set via the number of the piston teeth 12, 13 and pinion teeth 27. The system is independent of the direction in this embodiment due to the symmetrical design.

The determination of the pinion geometry with respect to the piston toothed arrangement is shown in FIGS. 16 and 17 for two embodiments. The angle a is in this respect formed from the center of rotation of the shaft 8 with respect to the contact surfaces at the piston 10. The angle b shows the angle width of the free-running region and is formed from the contact surface at the piston 10 with respect to the end of the radial sliding surfaces 34 and 35 of the pinion 15 on the positioning at the start of the free-running region. Angle c is formed from the intermediate region of the radial sliding surfaces 34, 35 of the pinion 15. The larger c is, the smaller the free-running region 19 becomes. Angle d is formed from the maximum extent of the radial sliding surfaces 34, 35 of the pinion 15 and angle e is formed from the starting points of the two radial sliding surfaces 34, 35 of the pinion 15. For the clean handover of the radial sliding surfaces 34, 35 of the pinion 15 to the contact surfaces of the piston 10 from one piston side to the other, $d>a$ and $e<a$ has to apply.

FIG. 18 shows the door movement schematically for an embodiment in accordance with FIGS. 2 to 7. The dashed representations of the leaf 1 designate the opening angle of the door on the coupling or decoupling of the pinion 15 from the piston 10. The double arrow 32 designates the free-running region between these two coupling positions, while arrow 36 designates the pulling open of the leaf and arrow 37 the pressing closed of the leaf.

LIST OF REFERENCE NUMERALS

1 leaf
2 frame
3 retraction apparatus
4 slide rail
5 slider
6 actuation arm
7 housing

8 shaft
9 reception space
10 piston
11 toothed arrangement
12 tooth
13 tooth
14 closing cover
15 pinion
16 entrainer
17 entrainer
18 spring
19 free-running region
20 damping space
21 valve arrangement
22 abutment
23 abutment
24 shoulder
25 shoulder
26 tooth spacing
27 pinion tooth
28 stop
29 stop
30 arrow
31 arrow
32 double arrow
33 arrow
34 radial sliding surface
35 radial sliding surface
36 arrow
37 arrow

The invention claimed is:

1. A retraction apparatus for a leaf of a door or of a window having a housing, a piston arranged in a reception space of the housing and acted on by a spring, and having a shaft which is supported in the housing and which cooperates with the piston, wherein an actuation arm for the leaf is rotationally fixedly arranged at the shaft, wherein at least one entrainer is arranged at the shaft and has a head surface forming a free-running device having a free-running region, wherein a stop of the piston or a tooth of a toothed arrangement of the piston sliding on the free-running region decouples the shaft from the piston, wherein the piston is a hollow piston and has two stops or toothed arrangements disposed opposite one another at the inner side of the hollow piston, wherein at least one first tooth is associated with the first toothed arrangement and at least one second tooth is associated with the second toothed arrangement , wherein during a complete opening cycle of the leaf both opposing stops or toothed arrangements cooperate with the entrainer or the entrainers.

2. A retraction apparatus in accordance with claim 1, wherein the entrainer in contact with one of the stops or with a tooth of the toothed arrangement couples the shaft to the piston.

3. A retraction apparatus in accordance with claim 1, wherein the oppositely disposed stops or toothed arrangements are symmetrical to one another.

4. A retraction apparatus in accordance with claim 1, wherein a first entrainer is arranged at the shaft and a second entrainer is arranged spaced apart from the first entrainer in the peripheral direction of the shaft.

5. A retraction apparatus in accordance with claim 4, wherein the first stop or the first tooth when in the free-running region on the first entrainer and the second stop or the second tooth when in the free-running region on the second entrainer hand over the free run of the leaf, in which the leaf is freely movable, from the first entrainer to the second entrainer.

6. A retraction apparatus in accordance with claim 4, wherein at least one pinion tooth is arranged between the first entrainer and the second entrainer, wherein tooth spacings are formed between adjacent pinion teeth and between the entrainers and the respective adjacent pinion tooth.

7. A retraction apparatus in accordance with claim 5, wherein at least one pinion tooth is arranged between the first entrainer and the second entrainer, wherein tooth spacings are formed between adjacent pinion teeth and between the entrainers and the respective adjacent pinion tooth.

8. A retraction apparatus in accordance with claim 4, wherein the first stop or the first toothed arrangement of the piston acted on by the spring, on engagement with the first entrainer or into a tooth spacing of the shaft, rotates the shaft and guides the leaf into a closing position; and/or in that the second stop or the second toothed arrangement of the piston acted on by the spring, on engagement with the second entrainer or into a tooth spacing of the shaft, rotates the shaft and guides the leaf into an open position.

9. A retraction apparatus in accordance with claim 5, wherein the first stop or the first toothed arrangement of the piston acted on by the spring, on engagement with the first entrainer or into a tooth spacing of the shaft, rotates the shaft and guides the leaf into a closing position; and/or in that the second stop or the second toothed arrangement of the piston acted on by the spring, on engagement with the second entrainer or into a tooth spacing of the shaft, rotates the shaft and guides the leaf into an open position.

10. A retraction apparatus in accordance with claim 6, wherein the first stop or the first toothed arrangement of the piston acted on by the spring, on engagement with the first entrainer or into a tooth spacing of the shaft, rotates the shaft and guides the leaf into a closing position; and/or in that the second stop or the second toothed arrangement of the piston acted on by the spring, on engagement with the second entrainer or into a tooth spacing of the shaft, rotates the shaft and guides the leaf into an open position.

11. A retraction apparatus in accordance with claim 1, wherein the piston comprises at least one abutment at which the entrainer comes into contact.

12. A retraction apparatus in accordance with claim 11, wherein the abutment engages into a lowered region of a shoulder at a pinion.

13. A retraction apparatus in accordance with claim 11, wherein the abutment is formed in the manner of a narrow tooth at the piston.

14. A retraction apparatus in accordance with claim 12, wherein the abutment is formed in the manner of a narrow tooth at the piston.

15. A retraction apparatus in accordance with claim 1, wherein the free-running region is formed as a variable contour.

* * * * *